US005137185A

United States Patent [19]

Mitchell

[11] Patent Number: 5,137,185

[45] Date of Patent: Aug. 11, 1992

[54] DISPENSER FOR MATERIAL IN SOLIDIFIED SLICK FORM

[75] Inventor: Paul B. Mitchell, Auckland, New Zealand

[73] Assignee: Tubepack Limited, Auckland, New Zealand

[21] Appl. No.: 654,220

[22] Filed: Feb. 12, 1991

[30] Foreign Application Priority Data

Apr. 12, 1990 [NZ] New Zealand ..... 233331

[51] Int. Cl.[5] ..... A45D 40/04

[52] U.S. Cl. ..... 222/390; 401/75; 401/175

[58] Field of Search ..... 222/389–391; 401/68, 75, 175, 171, 174

[56] References Cited

U.S. PATENT DOCUMENTS 4,298,036 11/1981 Horvath ..... 222/390 X
4,369,158 1/1983 Woodruff et al. ..... 401/175 X
4,545,696 10/1985 Carluccio ..... 401/175
4,605,330 8/1986 Crowley et al. ..... 401/175 X
4,664,547 5/1987 Rosenwinkel ..... 401/175
4,702,399 10/1987 Davis ..... 222/390
4,915,528 4/1990 Seager ..... 401/175 X
4,932,803 6/1990 Goldberger et al. ..... 222/390 X
4,950,094 8/1990 Yorks ..... 222/390 X

*Primary Examiner*—Michael S. Huppert
*Assistant Examiner*—Kenneth DeRosa
*Attorney, Agent, or Firm*—Abelman Frayne & Schwab

[57] ABSTRACT

A dispenser for materials in solidified stick form has an opening in the base of the dispenser through which said material in a heated liquid form can be introduced when the dispenser is in an inverted position for casting of the stick material directly within the dispenser, the opening being closed by a manually-operable knob after casting of the stick material, the knob being operative to actuate a threaded mechanism within the dispenser for extending the cast stick material through an opposite open end of the dispenser.

4 Claims, 4 Drawing Sheets

DISPENSER FOR MATERIAL IN SOLIDIFIED SLICK FORM

This invention relates to dispensing containers.

Containers of the type which the present invention relates are particularly suitable for packaging and dispensing materials such as lip sticks and deodorant sticks. Such products are packaged in compact containers which can be conveniently carried in a hand or sports bag. The containers are provided with winding mechanisms so that the product can be gradually wound out of the container as it is used. Over recent years there have been a number of developments in this area each aimed at improving manufacture and/or filling techniques. Examples are:

U.S. Pat. No. 4,369,158 which discloses a method of filling a container of this type with a solidifiable liquid wherein the winding mechanism is inserted after filling.

U.S. Pat. No. 4,298,036 which discloses a method of bottom filling where the solidifiable liquid is poured through a hollow base and an assembled stem structure.

GB patent No. 2163729A by Proctor and Gamble of the USA discloses which a further variation of a container which is filled in an inverted position.

While each of the above structures represents a step forward in the art the designs have provided limited access through which solidifiable material can be poured during packaging.

It is an object of the present invention to provide a dispensing container for solidifiable materials which can be filled in a pre-assembled inverted condition and which provides improved access for filling.

Further objects and advantages of the present invention will become apparent from the ensuing description which is given by way of example.

According to the present invention there is provided a dispensing container for solidifiable materials comprising a tubular container body having a first end through a stick of material can be extended, and a winding mechanism at the second end, said winding mechanism being secured relative to the second end of the body by an open frame and comprising a threaded winding shaft, a removable thumbwheel for winding the shaft and an open platform mounted on the threaded end of the shaft, the arrangement being such that, in the absence of the thumbwheel, a solidifiable material can be poured into the body via the second end passing through the open frame and platform.

Preferably the winding shaft is rotatably supported by the open frame.

The thumbwheel is fitted to the shaft after filling.

A filling cap is fitted to the first end of the container prior to filling.

Figure 1:
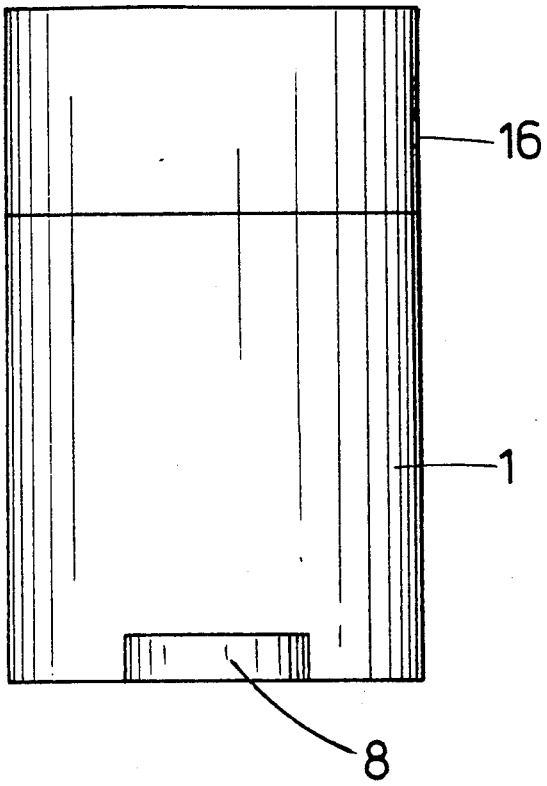
Figure 2:
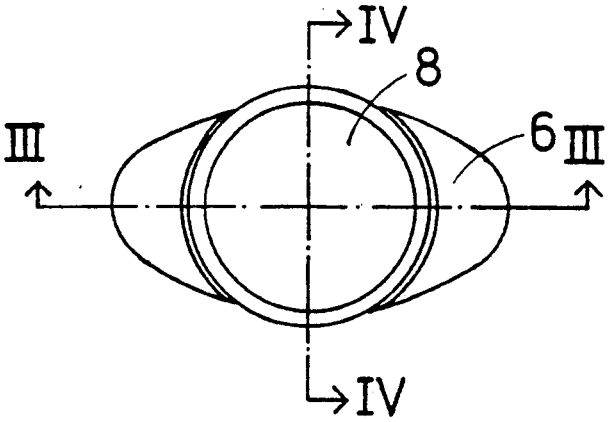
Figure 3:
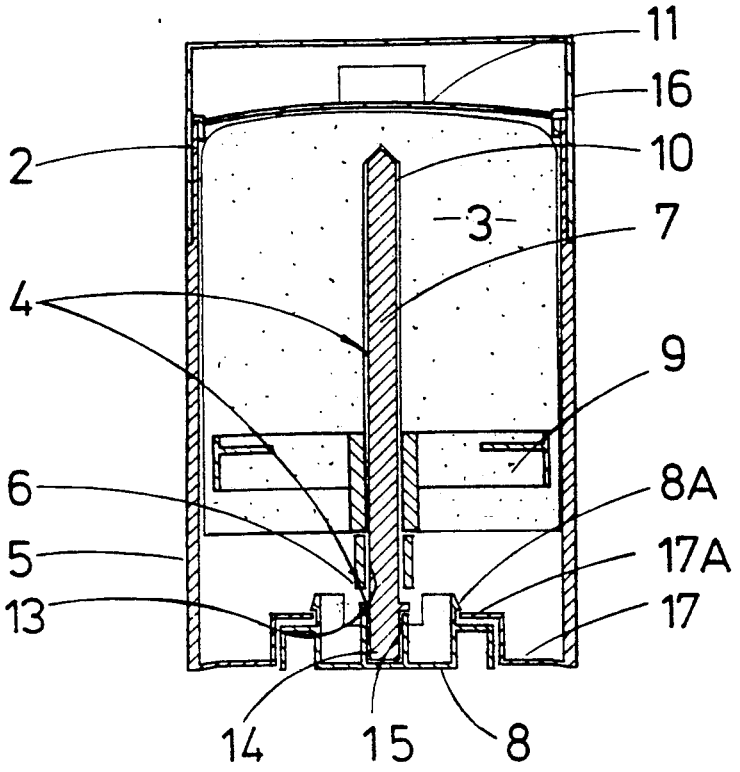
Figure 4:
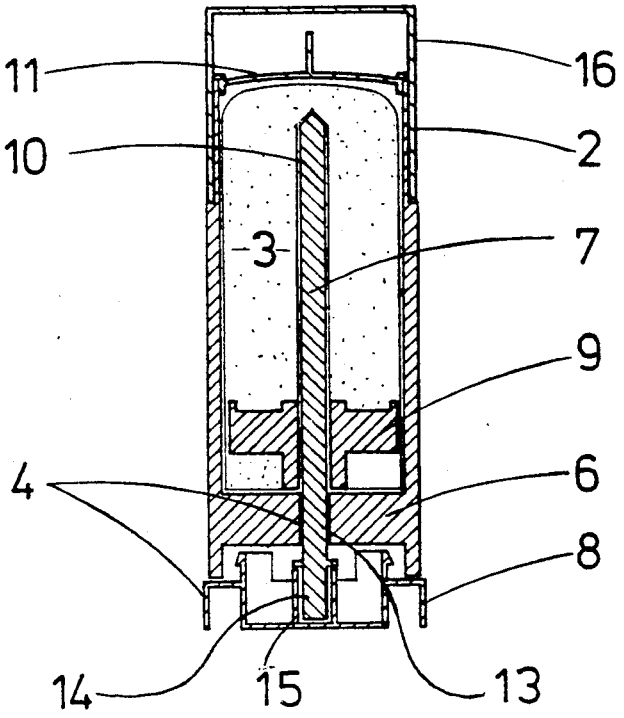
Figure 5:
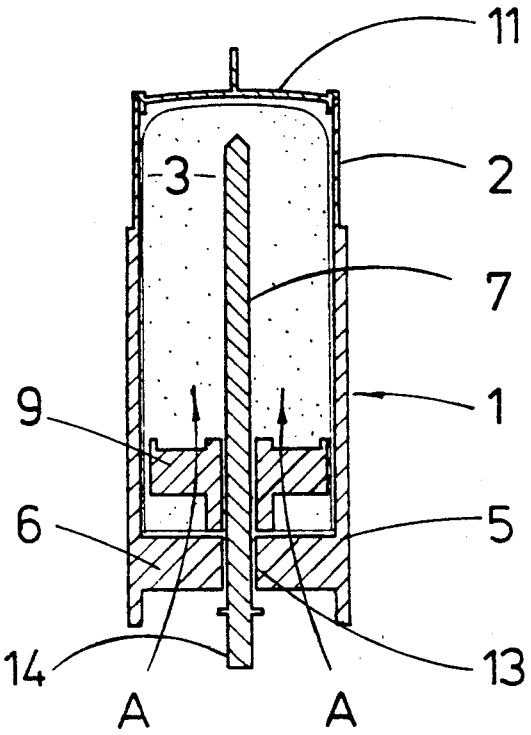
Figure 6:
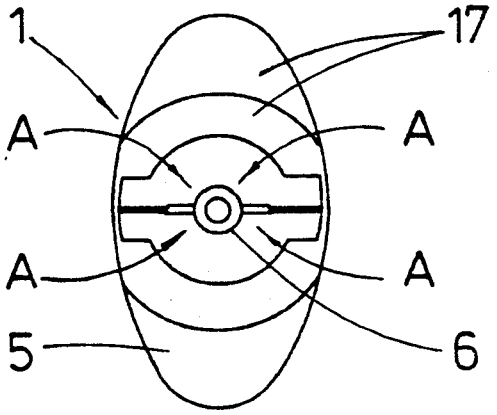
Figure 8:
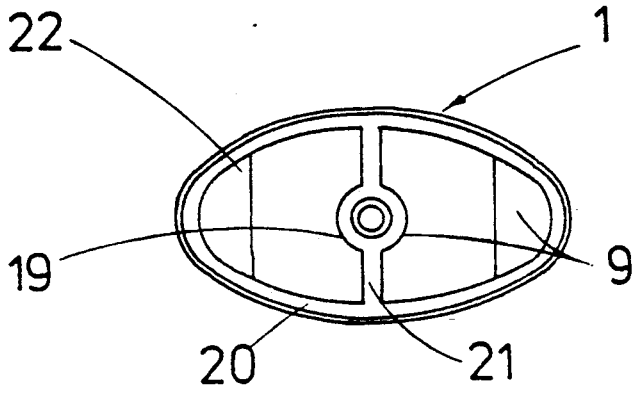
Figure 7:
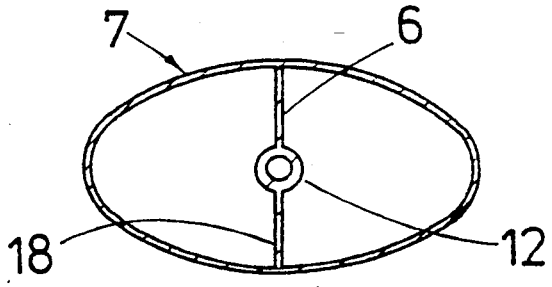

Aspects of the present invention will now be described with reference to the accompanying drawings in which:

FIG. 1 is a side view of a container in accordance with the present invention, and FIG. 2 is a bottom view of the container of FIG. 2, and FIG. 3 is a cross-sectional drawing taken through line III:III of FIG. 1, and FIG. 4 is a further cross-sectional drawing taken through line IV:IV of FIG. 2, and FIG. 5 is a view of the container of FIG. 1 in an inverted position with the thumbwheel removed, and FIG. 6 is a plan view of the container of FIG. 1 in an inverted position with the thumbwheel removed, FIG. 7 is a cross-section at VII:VII of FIG 5, and FIG. 8 is a cross-section at VIII:VIII of FIG. 5.

With respect to the drawings the dispensing container illustrated comprises a container body generally indicated by arrow 1 having a first end 2 through which a stick of solidified material 3 can be extended and a winding mechanism generally indicated by arrow 4 located with respect to a second end 5 of the body 1 by an open frame 6. The winding mechanism 4 comprises a threaded winding shaft 7, a circular thumbwheel 8 which can be joined to the shaft 7, and an open platform 9 mounted on the threaded part 10 of the shaft 7.

Prior to filling the container in an inverted position (see FIGS. 5 and 6) the first end 2 is capped with a cap 11 and solidifiable material 3 is poured as indicated by the arrows A past the open frame 6 and open platform 9 to a level which covers the open platform 9 but which is below the open frame 6. The material solidifies on both sides of the open platform 9 encapsulating the platform 9 and when the thumbwheel 8 and winding shaft 7 are turned the platform 9 and the solidified material will, after initial resistance until the surface tension between the walls of the container and the stick is overcome, be free to travel up and down within the container as the open frame 9 moves along the threaded shaft as a result of turning the thumbwheel 8.

The open frame 6 provides a bearing support 12 for a plain portion 13 of the winding shaft 7. Adjacent the plain portion 13 of the winding shaft 7 the shaft is formed with a drive head 14 complimentary to a socket 15 in the thumbscrew 8 so that when the thumbscrew is applied to the drive head and rotated the shaft 7 also rotates with resulting movement of the open platform 9 and solidified stick 3.

The container can be partially assembled prior to filling by fixing the shaft 7 in position, via end 5, fitting the open platform onto the shaft via end 2, winding the shaft so that the desired pre-filling position for the open platform is obtained and fitting cap 11. The cap 11 is fitted to cover the opening. After filling the thumbwheel 8 is fitted.

A closure cap 16 can be fitted before or after filling.

The container may be of oval or circular cross-section or a combination of both. Where the container is of an oval cross-section of the container can be partially enclosed by an appropriately shaped end housing 17. An inner flange 17A of the housing is used to lock the flange 8A of the thumbwheel in place although other means (not shown) may be used to lock the thumbwheel on the shaft.

FIGS. 6 and 7 and 8 of the drawings serve to illustrate that the structure described provides generous openings through which the solidifiable material can be poured. In the form illustrated the open frame 6 comprises ribs 18 joining support 12 to the sides of the body. Openings in the platform 9 are of slightly reduced size and include an internally threaded hub 19 supported from a ring 20 by ribs 21. Horizontal flanges 22 reduce the size of the opening and ensure there is sufficient surface contact between the stick material on opposite sides of the flanges to maintain the desired unity between the material and platform 9.

By comparison with existing containers of this type intended to be filled in an inverted position the aforesaid openings present a very small obstacle to incoming material. The container is simply pre-assembled prior to filling with the addition of the thumbwheel being all that is required to complete the assembly.

Aspects of the present invention have been described by way of example only and modification and additions thereto may be made without departing from the scope thereof as defined in the appended claims.

I claim:

1. A dispenser for a material in solidified stick form, comprising a container of tubular form having an open first end through which said stick material can be extended;

a bridge adjacent an opposite end of said container extending transversely of said container and secured to said container at opposite ends of said bridge, said bridge leaving substantially the entire transverse cross-section of said container unobstructed;

a threaded shaft journaled for rotation in an aperture in said bridge, said threaded shaft extending axially within said container and being threadedly engaged in an aperture of a platform extending transversely of the interior of said cylinder, said platform being held against rotational movement within said cylinder, and having openings extending therethrough through which said material in heated liquified form can readily flow;

a wall at said opposite end of said container providing a circular aperture that opens directly into the interior of said cylinder, said wall providing a journal for a winding knob engageable with said threaded shaft, whereby, prior to insertion of said winding knob into said circular aperture, free access is provided to the interior of said cylinder permitting filling of said cylinder with said material in a heated liquefied form for casting in situ within said cylinder, said winding knob being insertable into said circular aperture to close said circular aperture after filling of said cylinder with said winding knob in driving engagement with said threaded shaft.

2. The dispenser of claim 1, in which said container body is of oval cross-section.

3. The dispenser of claim 2, in which said bridge extends across the minor axis of said container body.

4. The dispenser of claim 1, in which said winding knob is provided with lugs that are a snap-fit within said circular aperture, and which are operative to locate said knob in an axially fixed position while permitting rotation of said knob relative to said container body.

* * * * *